United States Patent [19]

Biagioli

[11] Patent Number: 4,922,846

[45] Date of Patent: May 8, 1990

[54] MASTING FOR SAILBOATS

[76] Inventor: Mario Biagioli, Via Panziera 30 - 50047, Prato (Firenze), Italy

[21] Appl. No.: 284,319

[22] Filed: Dec. 14, 1988

[30] Foreign Application Priority Data

Dec. 17, 1987 [IT] Italy ..... 9580 A/87

[51] Int. Cl.[5] ..... B63H 9/04

[52] U.S. Cl. ..... 114/90; 114/39.1

[58] Field of Search ..... 114/89, 90, 97, 102, 114/109, 111, 39.1, 61, 209

[56] References Cited

U.S. PATENT DOCUMENTS

| | | | |
|---|---|---|---|
| 372,085 | 10/1887 | Post | 114/204 |
| 2,364,578 | 12/1944 | Wilkie | 114/39.1 |
| 2,756,711 | 7/1956 | Simpson | 114/39.1 |
| 2,944,505 | 7/1960 | Berge | 114/39.1 |
| 3,141,435 | 7/1964 | Moffitt | 114/39.1 |
| 3,395,664 | 8/1968 | Greenberg | 114/39.1 |
| 3,534,700 | 10/1970 | Marshall | 114/204 |
| 3,902,443 | 9/1975 | McDougali | 114/39.1 |
| 4,044,702 | 8/1977 | Jamieson | 114/39.1 |
| 4,273,060 | 6/1981 | Pavincic | 114/39.1 |
| 4,546,718 | 10/1985 | Schwartz | 114/39.1 |

*Primary Examiner*—Joseph F. Peters, Jr.
*Assistant Examiner*—Clifford T. Bartz
*Attorney, Agent, or Firm*—McGlew & Tuttle

[57] ABSTRACT

A masting for sailboats, which comprises: at least three poles, the lower end of which are fitted in the bridge or deck of the boat, while the upper ends are connected one to the other to form the vertex of an ideal pyramid whose corners are formed by said poles; and a plurality of stays in tension between said vertex and an anchoring point on the boat, the sails being borne by said stays.

10 Claims, 5 Drawing Sheets

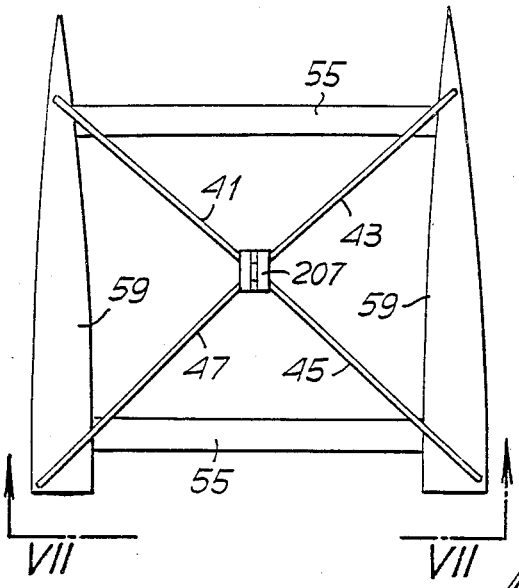
Fig. 6
Fig. 7
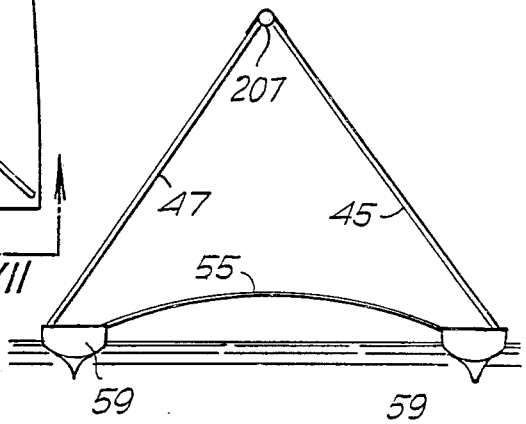
Fig. 8
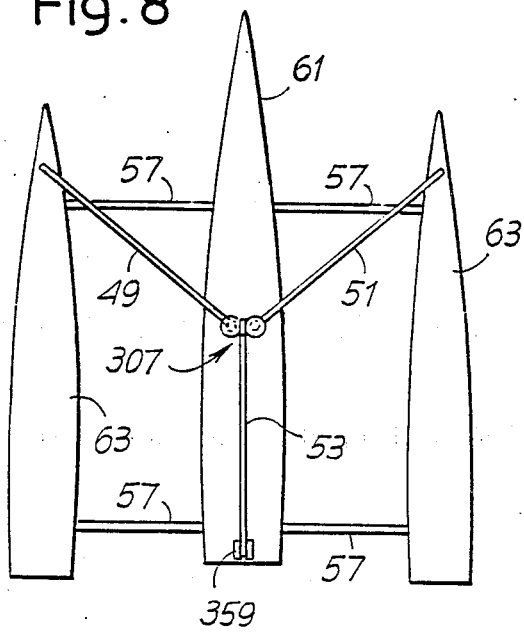
Fig. 9
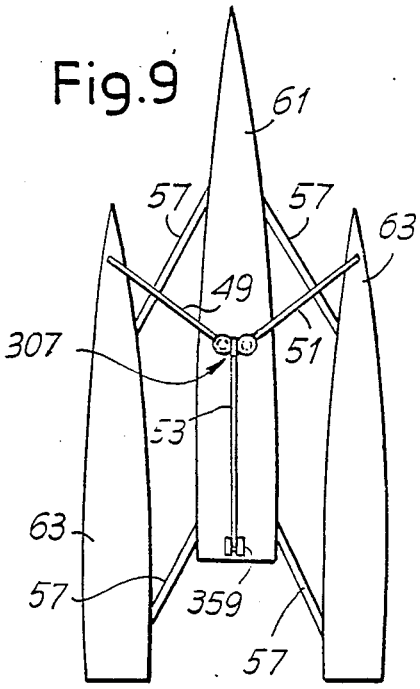

MASTING FOR SAILBOATS

FIELD AND BACKGROUND OF THE INVENTION

In the traditional sailboats, both single and multihull, the masting consists of a mast disposed on the longitudinal axis of the hull, which is supported by a plurality of shrouds and stays with eventually the aid of one or more pairs of crosstrees. This masting exhibits a series of structural and aerodynamic drawbacks. Under rest condition, the mast is compressed by symmetrical forces imposed by the rigging, while the shrouds and the stays are uniformly tensioned. Under wind-blowing condition, vice-versa, only the windward rigging is acted upon, resulting in heavy tensile stress, while the leeward rigging is partially unloaded or even in a slack condition, that is, released from the tension it is subject when at standstill. As a consequence, under a wind blowing condition, the mast is under a combined compression and bending stress, while the stress over the rigging is distributed only over a portion thereof, with consequent overstressing of the windward shrouds and of the hull at the anchorage points of the windward shrouds.

The structural problems related to the mastings the traditional type are even greater in the case of multihull boats. In fact, with catamarans, for example, the mast is borne by the structure connecting the two floats, while the shrouds are applied to the same floats. As the mast is under compression, the connection structure between the floats is stressed by high bending moments dynamically varying during the navigation. This gives rise to frequent breaks of such connection structures. A similar thing occurs with the trimarans, in which the mast is supported by the central float and the shrouds are anchored to the side floats. The connection structures are still subject to high bending moments of a dynamic nature during the navigation.

Moreover, the presence of the mast makes it compulsory to attach the main sails, especially jib and spanker, in correspondence of the boat central axis. This implies heavy restraints as far as the aerodynamic solutions of the sails are concerned; for example, with a traditional masting, the possible minimum value of the angle between the boat route and the real direction of the wind is about 45° (corresponding to the angle taken up by the boat during a close-hauled sailing). A smaller angle between the wind real direction and the boat route is not feasible.

SUMMARY AND OBJECTS OF THE INVENTION

It is an object of the invention to provide a masting for sailboats which neither has the above mentioned structural drawbacks nor the limitations in the distribution of sails while permitting a wide range of possible riggings.

Substantially, a masting for sailboats according to the invention is characterized by comprising: at least three poles, the lower ends of which are fitted in the bridge or deck of the boat at spaced apart points, while the upper ends are connected one to the other to make up the vertex of an ideal pyramid whose corners are formed by the poles themselves; and a plurality of stays in tension between said vertex and an anchoring point on the boat, the sails being borne by said stays and/or possibly also by the poles.

In one embodiment of the invention, a first one of said poles is applied abaft in correspondence of the longitudinal axis of the boat, other two poles are applied, symmetrically to the boat longitudinal axis, in correspondence of the vertex formed by the same poles or afore same vertex, and a plurality of stay anchoring points are disposed along said longitudinal axis.

Advantageously, further stay anchoring points may be disposed at the outside of the longitudinal axis of the hull.

In a particular embodiment, rails may be provided transverse to the hull axis, on which rails stay anchoring means are made to slide, so that the stays can be anchored in deck points that can be varied. The same rails may be used as sheet rails, further longitudinal sheet rails being possibly provided for the adjustment of the sheets.

In a further embodiment, the masting comprises four poles, the lower ends of which are symmetrically applied to the hulls of a multihull boat, a plurality of stays-anchoring points being provided on the hulls-connecting structures, or on the same hulls.

To allow a shifting of the vertex formed by said poles with respect to the hull, these poles may be made to slide on guides applied to the boat.

Advantageously, said poles may exhibit a cross-section having high compression-bending resistance, or a biconical structure.

In order to reduce the aerodynamic resistance of the mast, streamline profiles may be applied around said poles, rotating according to the wind direction.

Especially in the applications to the multihull boats, the poles may be realized in more sections, between said sections elastic members being interposed able to impart axial elasticity to the same poles, and tension-recovery members being provided for the stays.

The poles may form variable angles between them so as to allow a multihull boat to become "closed" by bringing the hulls close to each other.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

BRIEF DESCRIPTION OF THE DRAWINGS

In the drawings:

The drawing shows schematically a non limitative exemplification of the invention.

FIGS. 2 and 3 show schematic views on lines II—II and III—III of FIG. 1;

FIG. 6 shows a plan view of an application to a catamaran;

FIG. 7 shows a view on line VII—VII of FIG. 6;

FIG. 8 shows a plan view of an application to a trimaran;

FIG. 9 shows a plan view of an application to a multihull boat with hulls that can be closed;

DESCRIPTION OF THE PREFERRED EMBODIMENT

Figure 1:
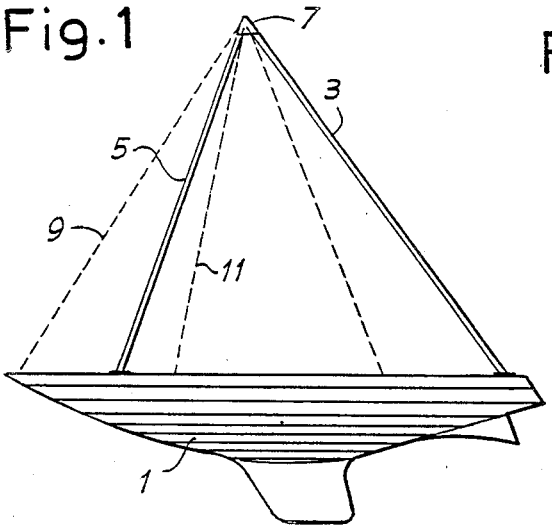
FIG. 1 shows, in schematic side view, the application of the masting, according to the invention, to a single-hull boat.
Figure 2:
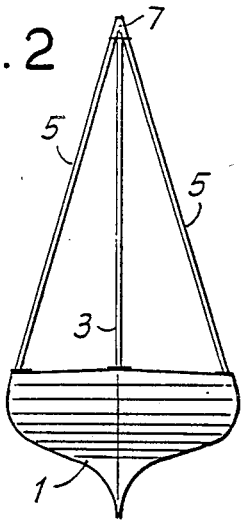
FIG. 2 is a schematic end view showing the application of the masting of the embodiment of FIG. 1.
Figure 3:
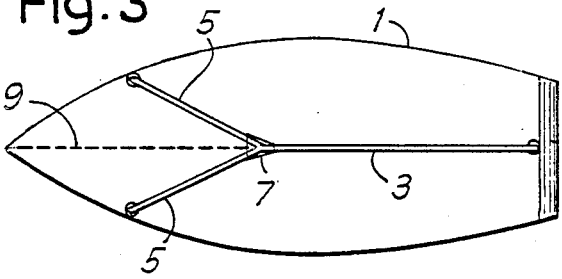
FIG. 3 is a schematic top plan view of the masting of the embodiment of FIG. 1.

FIGS. 1 to 3 show a first application of the invention to a single-hull boat. As it appears from the drawing, three poles 3, 5, 5 are applied to the hull, the first pole of which being anchored abaft and the second ones in correspondence of point 7 wherein the poles meet to make up an ideal pyramid or a masting structure (with triangular base, in this case), of which the poles themselves form the corners, or afore with respect to said point 7.

The masting comprises also a plurality of stays anchored, at one end, to the vertex 7 formed by poles 3, 5, 5, and at the other end, to suitable points of the bridge or deck of the boat. FIGS. 1 to 3 show two of these stays indicated by 9 and 11, respectively.

Figure 4:
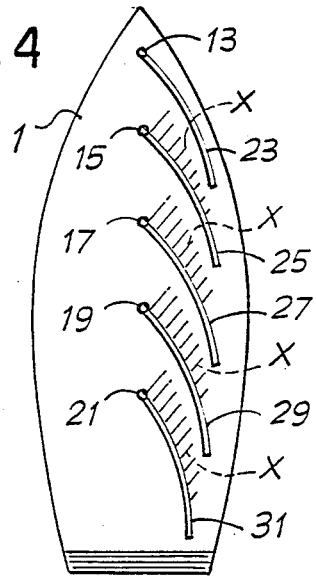
FIG. 4 shows a schematic plan view of a sails system obtainable by the masting according to the invention.

The stays may also be in number far greater than two. In the configuration of FIG. 4, in which the poles have been omitted for sake of clarity, five stays are provided, whose anchoring points indicated by 13, 15, 17, 19 and 21, respectively, are lined up along the longitudinal axis of the hull. To each of stays 13 to 21, sails 23, 25, 27, 29, 31—shown by their profile—are applied, which can be maneuvered by means of sheets likewise the traditional jibs of the sailing boats of known type.

Figure 5:
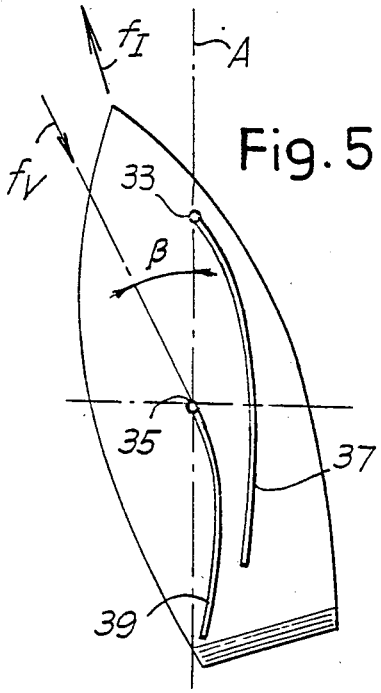
FIG. 5 shows a possible sails disposition for close-hauled sailing.

It is not necessary that the stays be anchored at points lined up along the boat axis, as shown in FIG. 4. In FIG. 5 a solution is shown in which two stays are anchored at points 33 and 35, respectively, these points not being lined up along the hull axis. The stays support sails 37, 39 indicated by their profile.

The disposition shown in FIG. 5 is particularly advantageous as it allows a close-hauled sailing with an angle between the boat route—indicated by arrow fI—and the wind real direction—indicated by arrow fV—to be significantly small, and surely smaller than that allowed by the traditional mastings with central mast. In fact, it is known that the wind entry angle with respect to the leading edge of the sails, that is, the angle between the direction of the apparent wind and the chord of such sails, cannot go below a predetermined minimum value, beyond which the fluid stream becomes detached from the sail with consequent turbulence or suppression of the aerodynamic force exerted on the sails. In the traditional mastings, the sails (in particular the spanker and the jib, as used when the boat is close hauled) are necessarily applied along the longitudinal axis of the boat, as the spanker is held by the mast and the jib by the bow stay. The attachment edges of the sails and, correspondingly, the so-called tack points, result thus lying on the symmetry plan of the hull. Since the angle between the direction of the apparent wind and the plane on which the sails attachment edges lie, cannot, for the above stated reasons, go below a predetermined value (corresponding to an angle of about 45° between the direction of real wind and the boat route), and since the boat advancement direction coincides with the straight line joining the jib and spanker tack points, it thus follows that—in the traditional boats—the angle between the boat advancement direction and the wind real direction cannot go below the above mentioned minimum value of approximately 45° . By the masting according to the invention, on the contrary, since the straight line joining the tack points must not necessarily be parallel to the axis of symmetry of the hull, it is possible to reduce the angle between the advancement direction and the real wind down to far lower values than 45° . In the schematic design of FIG. 5, for example, the plane on which the attachment edges of the sails lie, is indicated by its trace A on the horizontal, which corresponds to the straight line on which the tack points are lying and are coincident, in the plan view, with the trace of stays 33 and 35. The angle "$\beta$" between said trace and the wind real direction fV is again at least 45° , owing to the above stated reasons of fluid dynamics, but the angle between fV and fI is much smaller.

The possibility of distributing more sails as shown in FIG. 4 allows—the wind being equal —the same force to be obtained as that obtainable by a traditional masting while employing sails of far more limited height, with consequent reduction of the moment tending to turn the hull over. This greater aerodynamic force is achieved owing to a dual effect obtainable through the masting according to the invention. In fact, the possibility of distributing more stays 13, 15, 17, 19, 21 and relevant sails 23, 25, 27, 29, 31 provides, firstly, a larger sail area to rely on; secondly, for an increase of the space between two contiguous sails (indicated by X in FIG. 4), wherein the exploitation of the wind stream is at a maximum.

Figure 13:
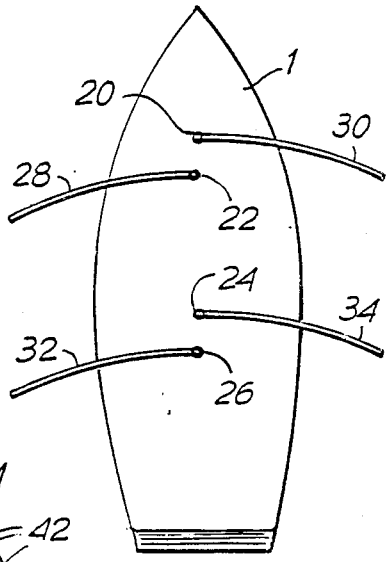
FIG. 13 shows a plan view of a possible disposition of the sails when sailing with the wind.

In practice, the possibility of having a high number of anchoring points for the stays, and the lack of a central mast allow the boat to be rigged in many different ways thereby obtaining, for every wind condition, a sail distribution which achieves an ideal aerodynamic exploitation of the available wind. FIG. 13 shows, in plan view and without poles for sake of drawing clarity, a possible disposition of the sails for sailing before the wind. In order to move forward before the wind, sails 28, 30, 32, 34 may be disposed in a butterfly arrangement—by means of booms—projecting very far with respect to the hull, with the sails being supported by suitable stays 20, 22, 24, 26. Advantageously, the fore sails 28, 30 are larger than the rear sails 32, 34. By a disposition of the illustrated type, it is possible to achieve large sail areas even without spinnaker, which is a rather dangerous sail and which is rather difficult to operate. In this way, the drawback deriving from the use of the spinnaker, whose sail area cannot be gradually adjusted, is avoided. On the contrary, by providing more sails 28, 30, 32, 34, the sail area can be easily regulated with graduality.

Figure 14:
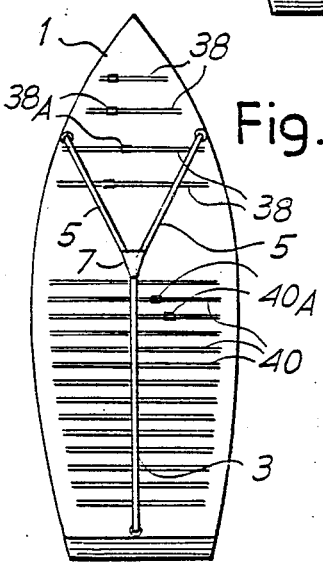
FIGS. 14 and 15 show possible dispositions of rails for maneuvering the sails.

The anchoring points of the stays on the deck or bridge of the boat may be predisposed in sufficient number, otherwise a set of rails 38, 40 may also be provided (FIG. 14), on each of which stays-anchoring elements (38A, 40A) can be fixed in the desired location. On each rail a number of anchoring elements may be provided forming anchoring means including rails for blocking the stays at suitable positions. As it appears from the drawing, the rails 40 are less spaced apart than rails 38. In this way, the rails 40 may be advantageously used also as sheet rails by providing blocks sliding on said rails for the movement of the sheets. By using openable blocks, it is possible to make the corresponding sheet shift from one to the other of rails 40 according to the navigation requirements. The operation of shifting the sheet from the block of one rail 40 to the block of a second rail 40, adjacent to the first one, corresponds to the movement of the same sheet along a rail disposed lengthwise to the hull.

Figure 15:
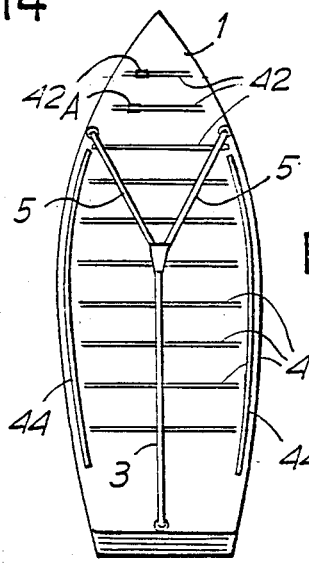

FIG. 15 shows another possible disposition of rails 42 for the stays anchoring means 42A and of rails 44 for the sheets maneuvring, said rails 44 being in this case longitudinal.

Under resting condition, that is, in absence of wind-caused stress, the stays result stressed by tension and the poles by compression, the poles 5 being, in particular, equally stressed. In case of stress of the sails due to the wind, the leeward pole is subject to a greater compression stress, while the windward pole may be subject to a lower compression stress or even to a tensile stress depending on the trim taken up by the stays bent by the aerodynamic force acting upon the corresponding sails. In any case, all poles and stays participate in the stress resulting from supporting the sails, the load on the hull resulting thereby being more distributed than in the case of traditional mastings with mast and shrouds, inasmuch as the leeward shrouds, being unable to withstand compression loads, are practically unloaded. Besides, considering that the points of the hull, in which the forces discharged by the poles 5 are applied, are spaced apart by an amount equal to the width of the hull in correspondence of the base of same poles, the stress transmitted to the hull is further reduced if compared to that of the traditional mastings in which, with the leeward shrouds in a slack condition, the points of application of the load onto the hull are spaced by an amount equal to half the width of same hull.

Still greater structural advantages can be achieved in the application to multihull boats as shown in FIGS. 6 and 8. In these embodiments, the structure formed by the poles, indicated by 41, 43, 45 and 47 in case of a catamaran and by 49, 51, 53 in case of a trimaran, cooperates with the structure 55 respectively 57 for the connection of floats i.e. hulls 59, respectively 61, 63. This involves a higher resistance of the connection structure to the dynamic stresses. Also the static stress on the connection structures is reduced due to the absence of a compressed mast in central position.

Figure 10:
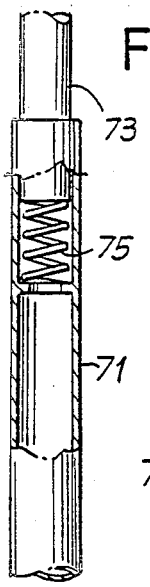
FIG. 10 shows a partial longitudinal section view of a cushioned pole.

In the application of the masting according to the invention to multihull boats, the connection structures between the floats are only stressed by the tension of the stays anchored thereto. Such stress is lower than the one a traditional mast is subject to. In addition, the elasticity of the stays (in metal rope) allows the dampening of dynamic forces arising during the navigation. A further resistence to the dynamic forces can be achieved by adopting sufficiently elastic connection structures and, possibly, poles made up of more sections between which elastic members are disposed acting as shock absorbers for dampening the blows over the floats due to waves and/or floating objects which may be hit during the navigation. FIG. 10 shows a feasible embodiment of a pole with elastic, shock-absorbing members. In this solution, the pole is made up of two telescopically mounted portions 71, 73 between which a spring 75 is interposed. In this case, means must be provided for the recovery of stays' tension.

The remarkable width of the multihull boats has brought about the need—in order to ease access into harbours—of building multihull boats with closeable structure, as shown in FIG. 9, for a trimaran. The movable connection structures of this type of boats result however very weak and not always capable of withstanding the strong dynamic stresses developing during the navigation. The use of a masting according to the invention allows for greater safety and resistance to be reached even in closeable multihull boats, as the poles assembly cooperates with the connection structure to withstand the stresses upon the floats.

The masting according to the invention allows the boat's deck to be fully cleared when the boat is at anchor. In fact, it is sufficient to release the stays from the respective anchoring points and retain them along the poles to make the whole deck easily accessible.

In addition, the presence of a high number of poles makes the boat more visible both to radar and optical means.

Figure 11:
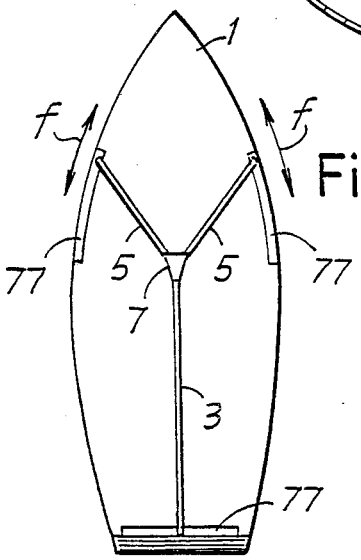
FIG. 11 shows a modified embodiment of the masting of FIG. 3.

The poles may be applied at non fixed points of the boat. FIG. 11 shows a schematic plan view of a single-hull boat, in which the poles 5 are applied on guides 77 and can be moved according to arrow f thereby determining a displacement of the vertex 7 with respect to the hull along the axis thereof, and a lowering or lifting of said vertex to/from same hull. Poles 3, 5, 5 are suitably hinged both at the vertex and at the point where they are connected to the hull, to allow these movements.

Figure 12:
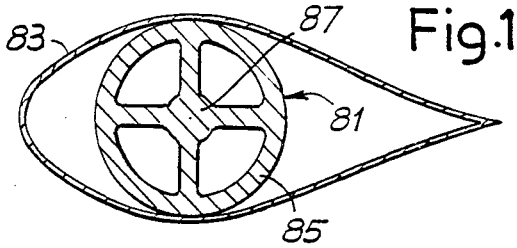
FIG. 12 shows a cross-section of a pole having a streamline profile.

In order to reduce the aerodynamic resistance of the poles during the navigation, provision may be made for fitting streamline profiles onto the poles. FIG. 12 shows a cross-section view of a pole 81 on which an aerodynamic profile developed in the shape of a cylindrical surface is fitted, having the cross-section shown in FIG. 12 and a height approximately equal to the whole longitudinal development of the corresponding pole. The profile 83 is rotatively mounted with respect to the pole axis, for example with the aid of ball-bearings, so as to allow the orientation according to the direction in which the wind is blowing.

FIG. 12 shows a cross-section of a pole having a high resistance to combined compression and bending stress. Such a pole, in fact, has an outer cylindrical sheath with circular cross-section 85 and an internal cross-shaped portion 87.

The masting according to the invention also allows the boom to be omitted which is a source of frequent accidents during navigation due to abrupt movements the boom is subject to as a consequence of the changes in the wind direction with respect to the boat.

Figure 16:
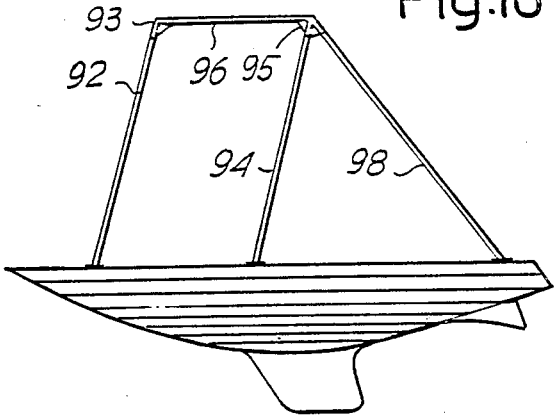
FIGS. 16 and 17 show a masting for large-size boats.
Figure 17:
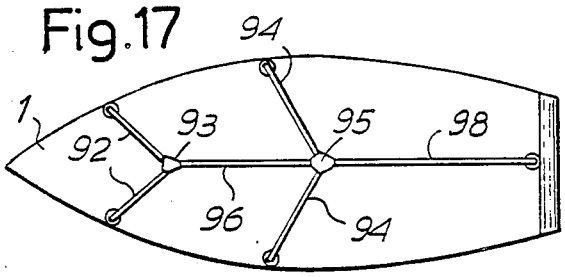

As for boats of great length are concerned, it is possible to predispose a high number of stays thereby obtaining a very large sail area with poles disposition of the type shown in FIGS. 16 and 17. In this disposition, to the hull 1—or to the deck thereof—two poles 92 ar applied converging into a vertex 93, and three poles 94, 94, 98 converging into vertex 95, the two vertices 93 and 95 being joined by a further pole 96. In this way, the stays may be applied throughout the length of the horizontal pole 96, instead of at a single point.

Figure 18:
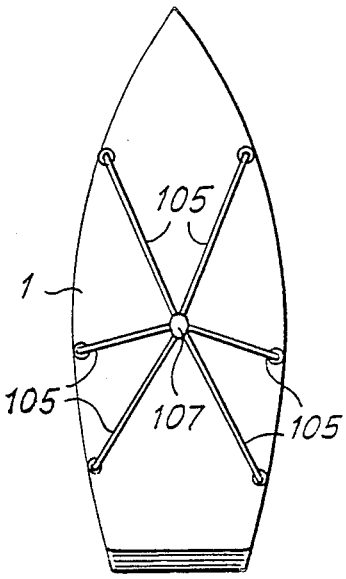
FIG. 18 shows a further embodiment of the masting.

FIG. 18 shows a modified embodiment of the masting according to the invention. In this embodiment, to the hull 1 a masting is combined, consisting of six poles 105 symmetrically disposed with respect to the central part of the boat and converging into a vertex 107. The function and the use of this masting are similar to those described for the other embodiments.

Figure 19:
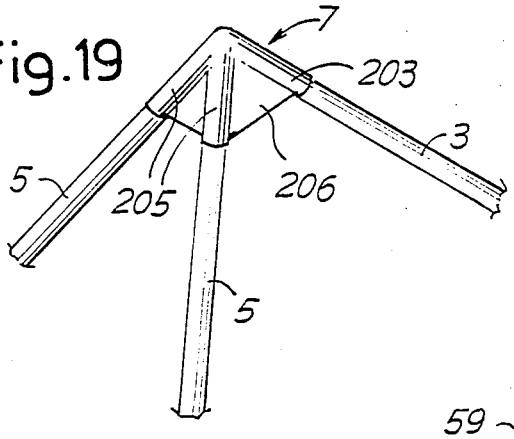
FIGS. 19; 20; and 21, 22 show possible embodiments of the vertex, respectively rigid and with feasible articulated joint.

FIG. 19 shows a feasible embodiment of the vertex 207 designed to provide relative angular positions between the poles converging thereto, such as those indicated by 3, 5, 5. The vertex consists, in this case, of a member made up of laminar gussets 206 which stiffen the seats 203, 205, 205 for said poles, relative to each other.

As above mentioned, two-hull boats (catamarans) or three-hull boats (trimarans) or others equivalent, may provide for moving the hulls close to each other in order to reduce the trasverse dimensions; this is useful on certain conditions. The masting according to the invention allows these closing movements of the hulls as can be seen by a comparison between FIGS. 6 (or 7) and 20 or between FIGS. 8 and 9.

Figure 20:
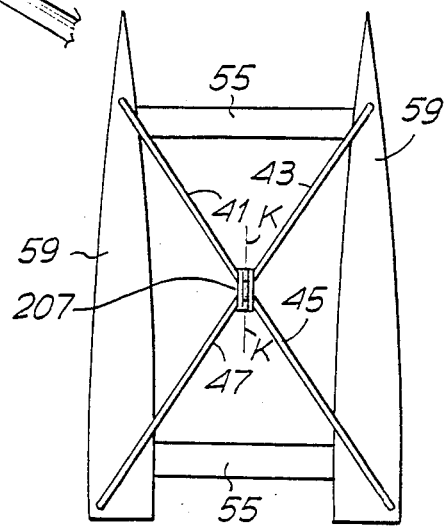

According to FIG. 20, the pairs of poles 41 and 47 and the pair of poles 43 and 45 are articulated one to the other at the vertex 207 around an almost horizontal and longitudinal axis K—K. In this way, the two hulls 59 may be moved close to or away from one another, by a suitably adjustable conformation of the connection structures such as those indicated by 55 which, however, is not dealt with by the present invention. The two poles 41 and 47 as well as the two poles 43 and 45 may be rigidly connected one to the other.

Figure 21:
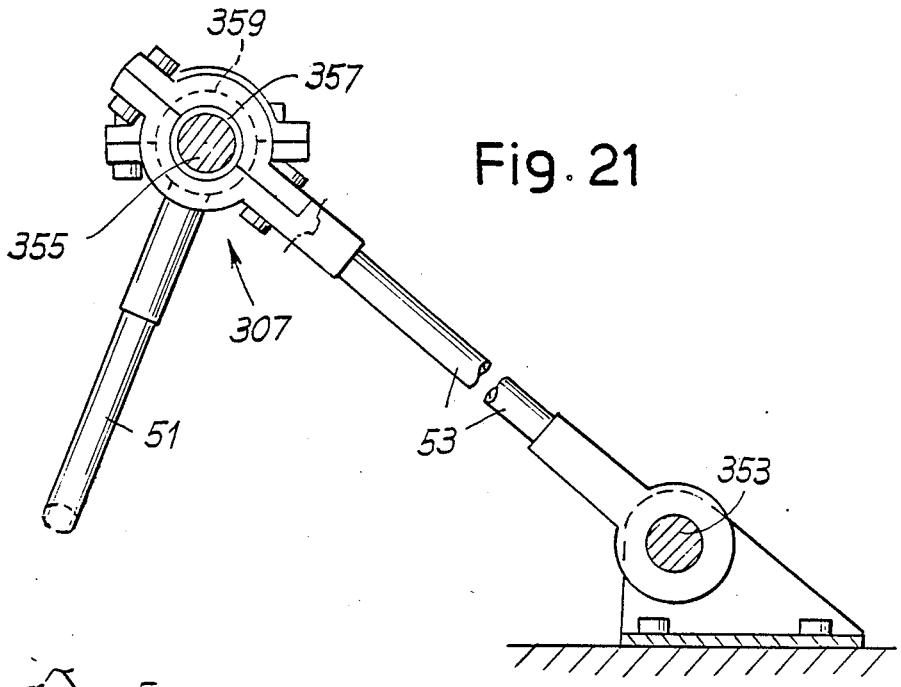
Figure 22:
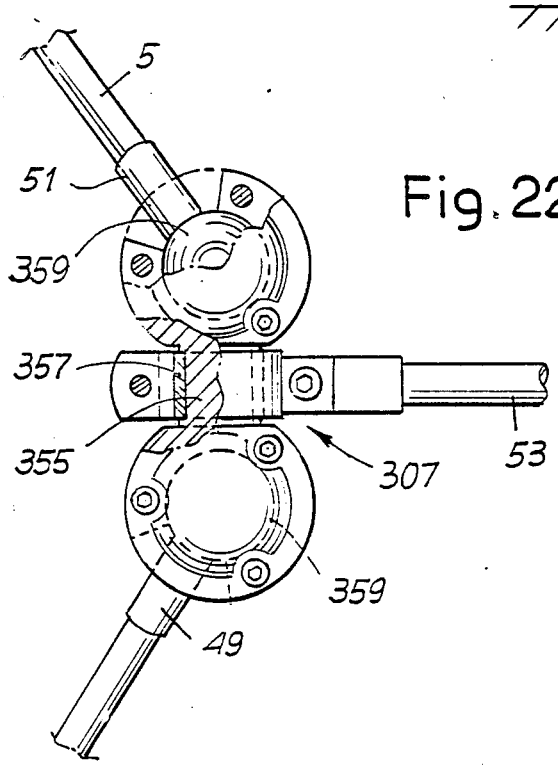

FIGS. 21 and 22 show a possible embodiment wherein an articulated joint is provided jointing three poles (like those indicated by 49, 51, 53 of FIGS. 8 and 9) at vertex 307, in order to allow for moving the two hulls 63 to and from the hull 61. A similar embodiment of the joint at the vertex may be adopted also for mounting the masting made up of poles 3, 5, 5 of FIGS. 1 to 3 or 11 or 14 or 15 said poles being connected to the same hull in different points thereof or to hulls of different dimensions. According to said FIGS. 21 and 22, the pole 51 is articulated at its lower part to the hull according to a trasverse axis along which a pivot pin 353 is provided. This pole 53 is articulated by means of a collar 357 to a trasverse axis of a cylindrical body 355. The body 355 makes up, at the two sides of the collar 357, the seats for two spherical joints 359, 359 for the upper ends of the two poles 49 and 51. The centers of the spherical joints lie on the trasverse axis defined by the cylindrical body 355. In this way, relative inclinations may be obtained between poles 49, 51 and 53, the poles 53 being able to move along the longitudinal vertical axis of symmetry of the boat.

The rear pole 3, 98 may also be replaced by a pair of respectively aft and fore stays disposed along the plane of symmetry of the hull.

The drawing shows only an exemplification of the invention, which may vary in the forms and dispositions.

I claim

1. A masting arrangement for sailboats comprising: a plurality of poles including at least three poles, each pole having a first end fixed to the sailboat and a second end, each said second end of said poles being joined to form a masting structure;

a plurality of stays, each stay being connected to the masting structure and extending downwardly to said boat, each stay being connectable to a sail for support of a sail;

anchoring means connected to the sailboat, said anchoring means for anchoring a plurality of stays to said sailboat, said anchoring means including a plurality of guide rails fixed to said sailboat and anchoring elements for fixing individual stays relative to one of said guide rails, said anchoring elements being movable with respect to said rail and fixable with respect to said rail, to move and fix corresponding sails in a longitudinal direction and a lateral direction with respect to the sailboat.

2. A masting arrangement according to claim 1, wherein said plurality of guide rails includes a plurality of guide rails extending laterally with respect to said sailboat.

3. A masting arrangement according to claim 1, wherein said plurality of guide rails includes a plurality of guide rails extending longitudinally with respect to said sailboat.

4. A masting arrangement according to claim 1, wherein said plurality of rails includes a plurality of rails extending laterally with respect to said sailboat and a plurality of rails extending longitudinally with respect to said sailboat.

5. A masting arrangement according to claim 1, wherein said plurality of poles includes four poles, two poles having first ends connected to a first hull of the sailboat and two poles having a first end connected to a second hull of the sailboat, said poles having second ends joined to one another.

6. A masting arrangement according to claim 1, wherein at least one of said poles includes a first end joined to said sailboat along a guide for moving the first end of said at least one pole with respect to said sailboat.

7. A masting arrangement according to claim 6, wherein said second ends of said poles are joined by a joint element allowing rotating of said poles around a longitudinal and substantially horizontal axis.

8. A masting arrangement for sailboats, comprising: a plurality of poles including at least three poles, each pole having a first end fixed to the sailboat and a second end, each of said second end of said poles being joined to a joint element to form a masting structure, said joint structure allowing movement of said poles relative to each other to form variable angles between the said poles; a plurality of stays, each stay being connected to the masting structure and extending downwardly to the sailboat, each stay being connected to a sail for independently supporting said sail; and, anchoring means, connected to said sailboat, said anchoring means for anchoring a plurality of stays to said sailboat, said anchoring means including a plurality of guide rails fixed to the sailboat and anchoring elements for fixing individual stays relative to said rail, said anchoring elements being movable with respect to said rail and fixable with respect to said rail to move and fix corresponding sails longitudinally and laterally with respect to the sailboat.

9. A masting arrangement according to claim 8, further comprising adjustable connection means for connecting said poles to said boat and for varying the position of the connection of said poles to said boat for adjusting said masting structure.

10. A masting arrangement according to claim 8, wherein said plurality of poles includes two additional poles connected to said joint structure by a further pole forming a masting structure connected to the sailboat at five points.

* * * * *